US006513658B1

(12) United States Patent
Adkins

(10) Patent No.: US 6,513,658 B1
(45) Date of Patent: Feb. 4, 2003

(54) PROTECTIVE PACKAGE

(75) Inventor: Richard E. Adkins, Oak Creek, WI (US)

(73) Assignee: Adkins Collectable Toys, Ltd., Franklin, WI (US)

( * ) Notice: Subject to any disclaimer, the term of this patent is extended or adjusted under 35 U.S.C. 154(b) by 0 days.

(21) Appl. No.: 09/880,572

(22) Filed: Jun. 13, 2001

(51) Int. Cl.[7] ..... B65D 81/02
(52) U.S. Cl. ..... 206/522; 206/583; 206/594
(58) Field of Search ..... 206/522, 583, 206/591–594; 383/3

(56) References Cited

U.S. PATENT DOCUMENTS

| | | | | | |
|---|---|---|---|---|---|
| 3,138,248 | A | | 6/1964 | Abbott | |
| 3,302,780 | A | | 2/1967 | Massman et al. | |
| 3,340,669 | A | | 9/1967 | Farquharson | |
| 3,889,743 | A | | 6/1975 | Presnick | |
| 4,155,453 | A | * | 5/1979 | Ono | 206/522 |
| 4,190,158 | A | | 2/1980 | Ambrose | |
| 4,215,778 | A | * | 8/1980 | Kovins | 206/522 |
| 4,240,556 | A | | 12/1980 | Field | |
| 4,262,801 | A | * | 4/1981 | Avery | 206/522 |
| 4,573,202 | A | * | 2/1986 | Lee | 206/522 |
| 4,801,213 | A | * | 1/1989 | Frey et al. | 206/522 |
| 4,872,558 | A | | 10/1989 | Pharo | |
| 4,874,093 | A | | 10/1989 | Pharo | |
| 4,918,904 | A | | 4/1990 | Pharo | |
| 4,949,530 | A | | 8/1990 | Pharo | |
| 5,183,159 | A | | 2/1993 | Hojnacki et al. | |
| 5,397,000 | A | * | 3/1995 | Holte et al. | 206/522 |
| 5,487,470 | A | | 1/1996 | Pharo | |
| 5,676,509 | A | | 10/1997 | Enzu | |
| 5,762,197 | A | | 6/1998 | Farison | |
| 5,769,232 | A | | 6/1998 | Cash et al. | |
| 5,833,051 | A | | 11/1998 | Tiefenbrun et al. | |
| 5,901,850 | A | | 5/1999 | Jones et al. | |
| 5,967,324 | A | | 10/1999 | Izzo | |

* cited by examiner

*Primary Examiner*—Luan K. Bui
(74) *Attorney, Agent, or Firm*—Andrus, Sceales, Starke & Sawall, LLP

(57) ABSTRACT

A protective package includes first and second package frame members, each having inner surfaces including a planar face and side walls which define a well extending therebelow. The frame members have a hinge connection to permit movement between an opened position and a closed position wherein the frame members are positioned face-to-face. Structure is included for locking the frame members in the closed position. A first collapsible film has outer edges secured to inner edges of the first frame member to create a first inflatable chamber between the first well and the first film. A second collapsible film has outer edges secured to inner surfaces of the second frame member to create a second inflatable chamber between the second well and the second film. A flexible tube extends across the hinge connection placing the first and second chambers in communication with each other. One of the frame members has a one-way valve for introducing and maintaining a filler medium in the first and second chambers by means of a blowhole formed in one side wall of the one frame member.

9 Claims, 4 Drawing Sheets

PROTECTIVE PACKAGE

FIELD OF THE INVENTION

This invention relates broadly to developments in packaging and, more particularly, pertains to a package having a collapsible film arrangement for placing an article in protective suspension during shipping.

BACKGROUND OF THE INVENTION

There are various known packaging designs by which an item to be shipped or transported is contained within an enclosure or envelope which is thereafter sealed and inflated to protect the item. Many of these packaging designs involve double walled constructions of inner and outer flexible sheets, panels or envelopes having inflatable chambers between them with pressurized air causing encapsulation of the item between the inner panels. Such designs are not always reusable, are prone to puncture and often have curved or rounded, outer inflated surfaces which are not conducive to being easily received in commercially available outer shipping containers or boxes.

Another known protective packaging design includes a pair of rigid plastic frame members which carry removable insert trays having resilient, non-inflatable films. When the package is closed, the resilient films stretch around an object to be shipped. While this design may be more easily placed in a supplementary outer container, the resilient films do not always hold the object to be shipped tightly. In addition, there is the need to occasionally replace the insert trays and resilient film which can add to the cost of this design.

Accordingly, there is a need for a differently styled, reusable, inflatable package which combines the best features of the prior art without any of the drawbacks. It is therefore desirable to provide a package which maintains its outer configuration yet substantially surrounds the entire surface area of any object to be shipped in a manner that produces optimum protection. It is further desirable to provide a package which is easily transformed between opened and closed positions without heat sealing or the like.

SUMMARY OF THE INVENTION

It is one object of the present invention to provide a package having a pressurized film arrangement which is integral with an outer closable container.

It is also an object of the present invention to provide a package having a transparent structure which avails itself to inspection of the item being shipped.

It is another object of the present invention to provide a package which is adequately sealed to prevent entry of moisture, dirt and other contaminants which may negatively affect the item to be shipped.

It is a further object of the present invention to provide a package which is adapted to be received in a commercially available shipping container.

It is an additional object of the present invention to provide a package which is economical, compact and will provide complete protection of the item during shipment, storage and handling.

In one aspect of the invention, a protective package includes first and second frame members, each having inner surfaces including a planar face and side walls which define a well extending therebelow. The frame members have a hinge connection to permit movement between an opened position and a closed position wherein the frame members are positioned face-to-face. The package includes structure for locking the frame members together in the closed position. A first collapsible film has outer edges secured to inner surfaces of the first frame member to create a first inflatable chamber between the first well and the first film. A second collapsible film has outer edges secured to inner surfaces of the second frame member to create a second inflatable chamber between the second well and the second film. A flexible tube extends across the hinge connection placing the first and second chambers in communication with each other. One of the frame members has a one-way valve for introducing and maintaining a filler medium such as air in the first and second chambers by means of a blowhole formed in one side wall of the one frame member. One of the frame members is provided with a relief valve for releasing air from the chambers. The relief valve is comprised of an aperture formed in one of the wells, and a closure strip attached to an external surface of the well to selectively open and close the aperture. Each of the frame members is preferably constructed of a rigid, clear plastic material. The first and second collapsible films are preferably constructed of a clear plastic material. The inner ends of the first and second collapsible films are formed with throughholes in communication with opposite ends of the flexible tube. The one-way valve is a duckbill valve.

In another aspect of the invention, there is provided a package for protecting an object to be shipped. The package has a pair of rigid frame members, each having surfaces including a planar face and side walls which define a well extending therebelow. The frame members have a hinge connection to permit movement between an opened position and a closed position wherein the frame members are positioned face-to-face. The improvement relates to a collapsible film arrangement secured to inner surfaces of the frame member to define an inflatable chamber between the film arrangement and each well, each chamber being in communication with the other. One of the frame members has a one-way valve for introducing air into the chambers by means of a blowhole formed in one side wall of the one frame member. Introduction of air into the chambers will maintain the shape of the frame members and will cause the film arrangement to tightly collapse upon and adhere to substantially an entire surface area of an object placed on an inner surface of the film arrangement to protectively suspend the object between the frame members.

Various other features, objects and advantages of the invention will be made apparent from the following description taken together with the drawings.

BRIEF DESCRIPTION OF THE DRAWINGS

The drawings illustrate the best mode presently contemplated in carrying out the invention.

In the drawings.

DETAILED DESCRIPTION OF THE INVENTION

Figures 1, 2:
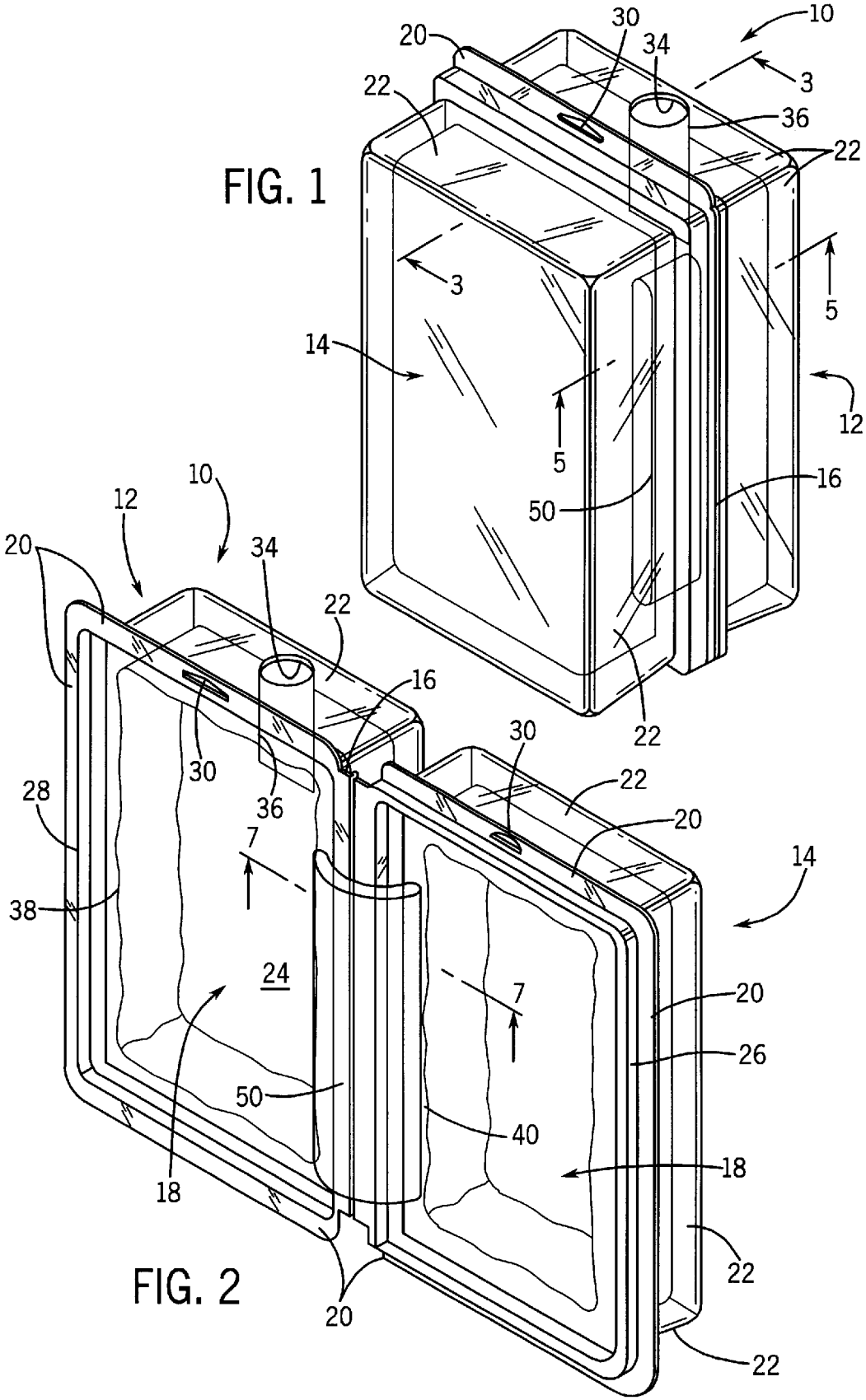
FIG. 1 is a perspective view of a closed protective package formed on a surface with a blowhole in communication with an inner sealing film arrangement according to the present invention.
FIG. 2 is a view similar to FIG. 1 but showing the package opened.

The drawing figures illustrate a preferred embodiment of the present invention in the form of a reusable, protective package for safeguarding an object suspended in a pressurized pocket between a collapsible film arrangement. It should be understood that the shape and size of the package and the object may vary from that shown herein.

Referring now to the drawings, FIGS. 1 and 2 are perspective views of a protective package 10 embodying the present invention. As illustrated, the package 10 has a clam shell configuration in which two frame members 12, 14 constructed of rigid PVC plastic are connected between opened and closed positions by a reclosable hinge connection 16. Each frame member 12, 14 defines a tray-like well 18 and a flanged, planar face 20. Each well 18 includes a series of side walls 22 and a bottom wall 24, all of which were integrally molded or formed together. In the preferred embodiment, the frame members 12, 14 are formed of transparent plastic to permit the inspection of the item to be shipped therein. However, it is to be noted that the frame members 12, 14 could be made of rigid materials other than plastic, could be any color and could have special properties for further protecting the item to be shipped.

Figure 5:
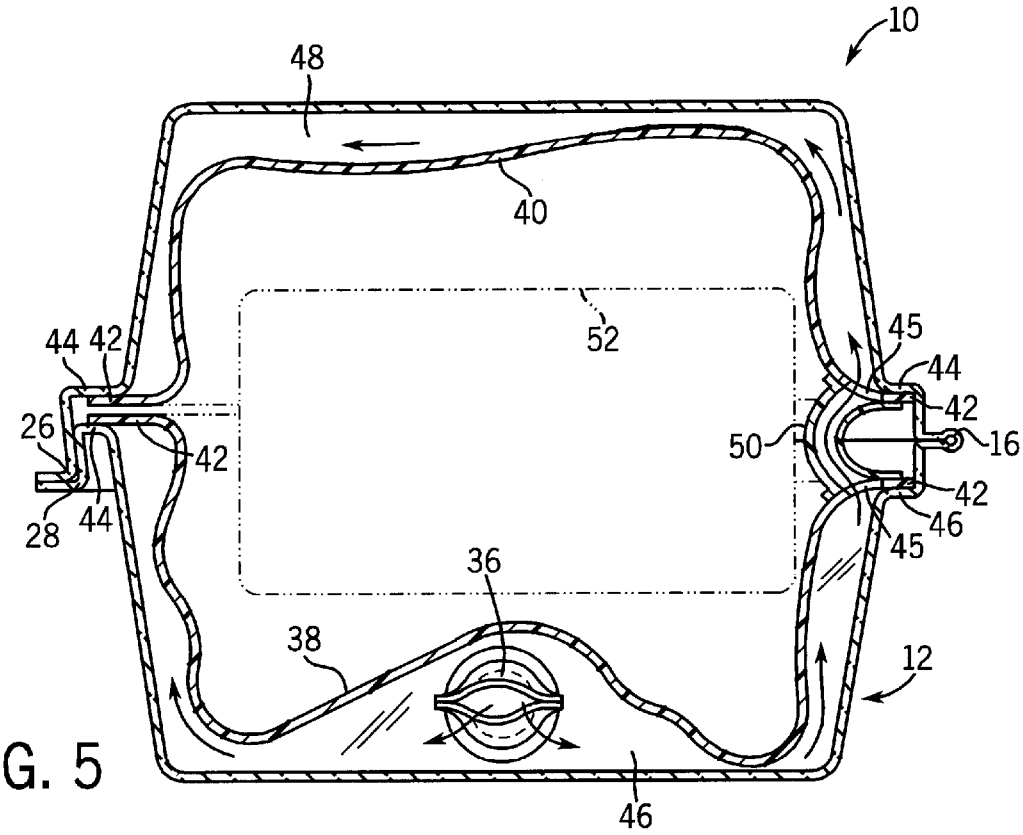
FIG. 5 is a sectional view taken on line 5—5 of FIG. 1.
Figure 6:
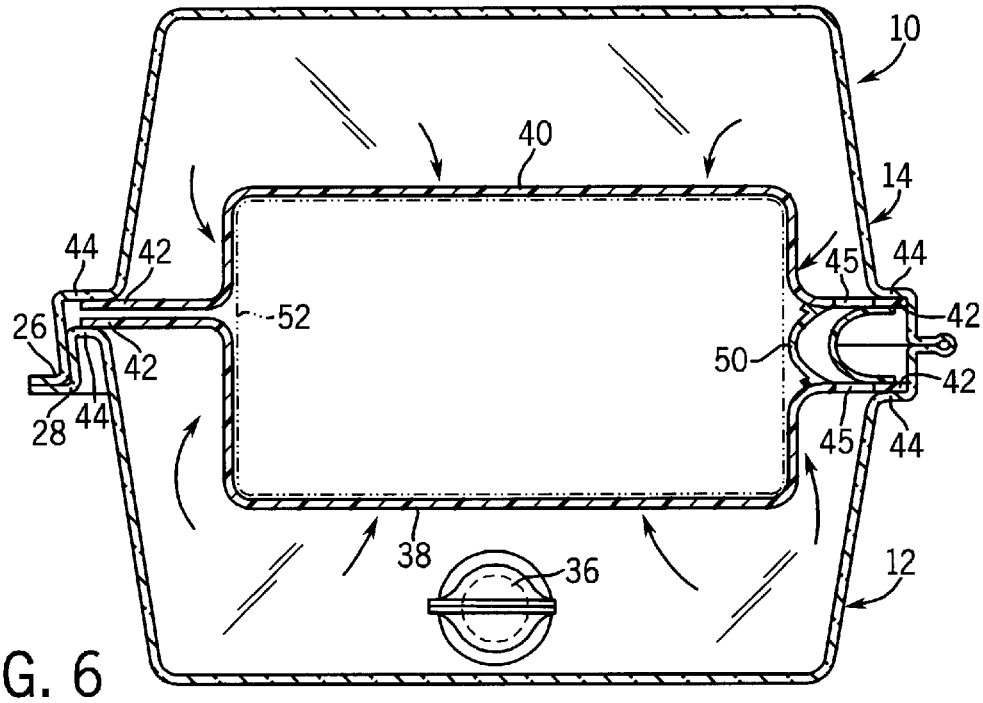
FIG. 6 is a sectional view like FIG. 5 showing the sealing film arrangement tightly collapsed around the object.

Hinge 16 is designed to allow swinging movement of the frame members 12, 14 between the opened position of FIG. 2 and the closed position of FIG. 1 in which the planar faces 20 are positioned in face-to-face relationship. The package 10 contains locking structure to keep the frame members 12, 14 in the closed position. In the preferred embodiment, integral locking structure is provided on opposed edges 26, 28 on frame members 12, 14. As best seen in FIGS. 5 and 6, the edges 26, 28 have complimentary surfaces which provide for a frictional or snap fit.

Figure 3:
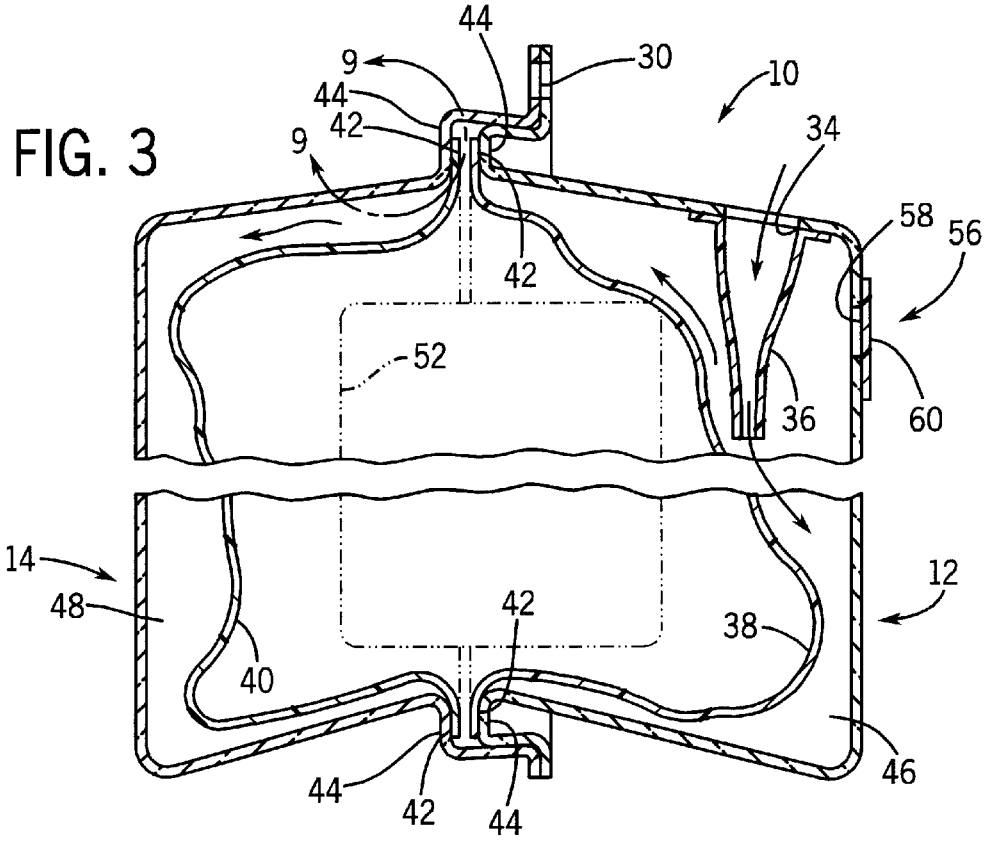
FIG. 3 is a sectional view of the package taken on line 3—3 of FIG. 1 and showing an object to be sealed within the package with the sealing film arrangement encapsulated around the object.
Figure 4:
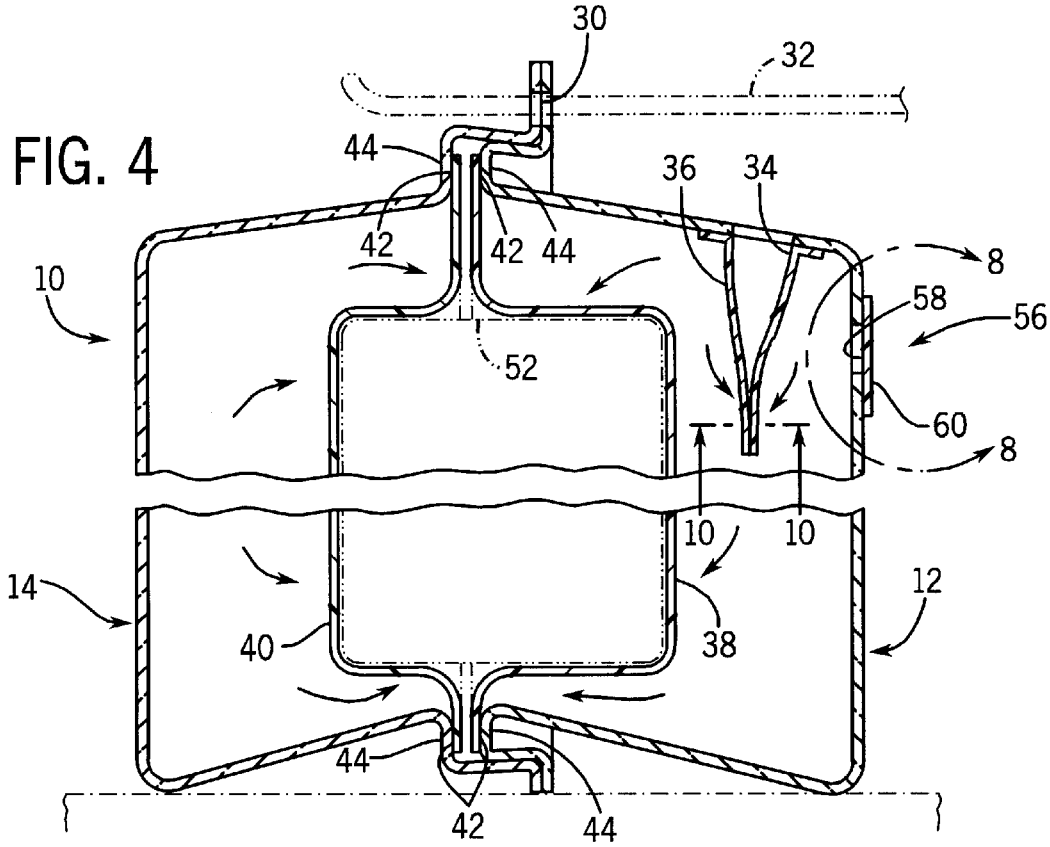
FIG. 4 is a sectional view like FIG. 3 showing the sealing film arrangement tightly collapsed about the object.

With further reference to FIGS. 1 and 2, the top surfaces of each planar face 20 are formed with apertures 30 so that when the frame members 12, 14 are in the closed position, the apertures 30 will be in alignment with each other. The apertures 30 serve to provide a means by which the closed package 10 may be hung, such as on a hangar rod 32 (FIG. 4). It can also be seen that the top surface of one of the frame members 12 is formed with a blowhole 34. The inner surrounding walls of the blowhole 34 act as an attachment surface for a one-way, duckbill valve 36 which is better illustrated in FIGS. 3 and 4. As will be appreciated hereafter, introduction of air by means the blowhole 34 and the valve 36 allow air to be delivered inside the frame members 12, 14 and will not allow the escape of air through the blowhole 34 and valve 36.

Figure 7:
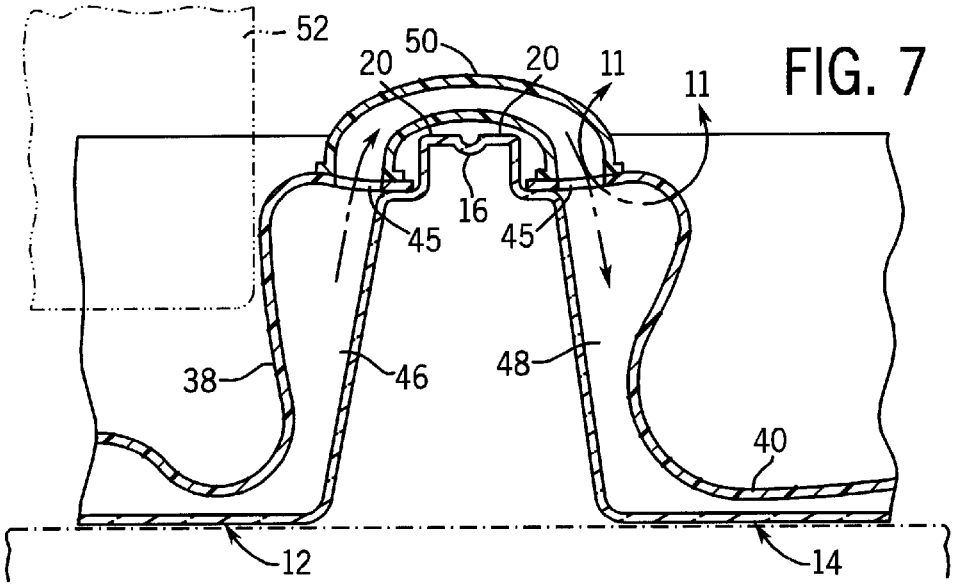
FIG. 7 is a partial sectional view taken on line 7—7 of FIG. 2.
Figure 11:
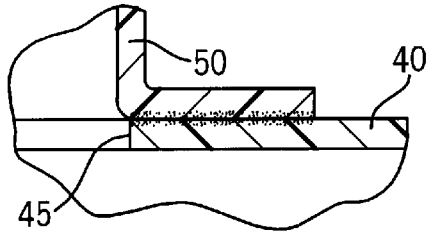
FIG. 11 is an enlarged sectional detail view taken on line 11—11 of FIG. 7.
Figure 9:
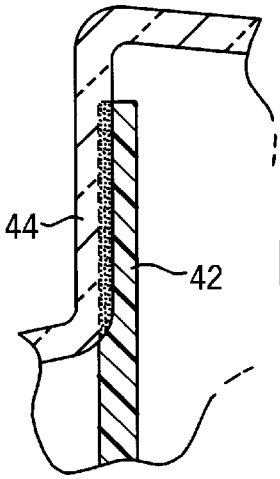
FIG. 9 is an enlarged sectional detail view taken on line 9—9 of FIG. 3.

Turning to FIGS. 3, 4, 5 and 6, protective package 10 also includes a collapsible film arrangement in the form of a pair of collapsible films 38, 40, typically formed of a clear, mylar material. Each of the films 38, 40 have inner edges 42 which are tightly and sealingly bonded to the inner surfaces of the frame members 12, 14. More specifically, the films inner edges 42 are joined to.offset portions 44 of the wells 18 adjacent to planar faces 20. FIG. 9 shows a detailed view of the film-well inner surface joinder taken at the top of the package 10. As seen in FIG. 7, innermost ends of the films 38, 40 at the top of the package 10 are formed with throughholes 45 for a purpose to be explained below. Between each film 38, 40 and its respective well 18, there is defined a pair of respective inflatable chambers 46, 48. In order to place each chamber 46, 48 in communication with each other, a connecting flexible conduit 50 extends across the innermost planar faces 20 on either side of hinge 16 and has ends bonded to the surrounding walls of the throughholes 45 formed in the films 38, 40 as illustrated in FIGS. 7 and 11. The flexibility of the conduit 50 allows it to assume a compressed, curved configuration when the package 10 is closed (FIGS. 5 and 6) without impairing its communicating ability.

Figure 10:
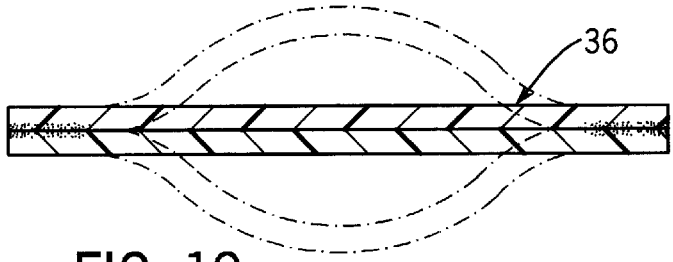
FIG. 10 is a partial sectional view taken on line 10—10 of FIG. 4.

In use, one simply places an object 52 to be protectively shipped upon one of the films 38, 40 and then closes the opposing frame member 14 onto the other frame member 12 in a snap fit as previously described. Then, placing one's lips over the blowhole 34, air is blown into chamber 46, passes through conduit 50 and flows into the other chamber 48 as shown by the arrows of the figures. Each delivery of air is accumulated in the chambers 46, 48 and will not backflow or leak out because of the one-way valve 36 which closes after each air delivery (FIG. 10). Progressively, the pressurization of the chambers 46, 48 will cause the films 38, 40 to tightly collapse and adhere to substantially the entire surface area of the object 52 placed between the films 38, 40. In this fashion, the object 52 is carefully suspended between the frame members 12, 14 to provide complete protection during handling, shipment and storage. The object 52 is also sealed from moisture, dirt and other contaminants which might otherwise damage the object. Once the object 52 has been protectively suspended, the package 10 may be shipped on the hangar rod 32 or may be deposited in a shipping container of the type currently available with commercial shippers such as UPS, Federal Express or the U.S. Postal Service.

Figure 8:
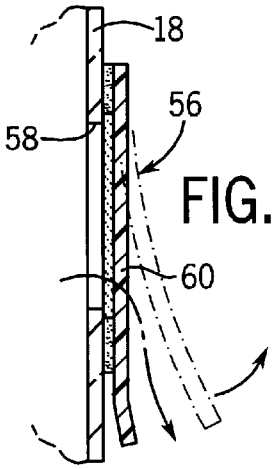
FIG. 8 is an enlarged sectional detail view of a relief valve taken on line 8—8 of FIG. 4.
Figure 12:
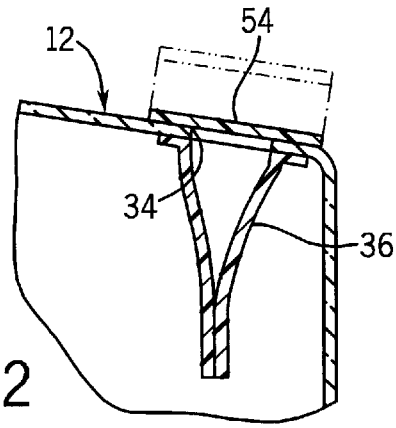
FIG. 12 is an enlarged sectional detail view of an optional closure disposed over the blowhole shown in FIG. 4.

In some cases, it may be preferable to supply an optional closure 54 (FIG. 12) over the blowhole 34 to prevent the entry of contaminants into the valve 36 during shipping. Also, it should be understood that the package 10 is reusable simply by permitting the pressurized air in the chambers 46, 48 to escape via a relief valve 56 (FIG. 8) located on at least one of the wells 18. The relief valve 56 is comprised of an aperture 58 normally sealed by releasable adhesive strip 60 or the like. Once the air is exhausted, the package 10 may be opened to retrieve the object 52 placed inside. Thereafter, the package 10 is used to again in the manner described above.

It should now be appreciated that the present invention provides a package which is economical, compact and offers complete protection for any object to be shipped. The package has particular utility in the safe transport of collectibles and other fragile articles but may be used with any industrial or consumer product. The protective package may be viewed as an improvement in currently existing clam shell display packages such as manufactured by the assignee of this application. Unlike prior inflatable designs, the outer frame members of the invention retain their original configuration to make entry into an additional commercial shipping container easier. In contrast with previous clam shell counterparts, there is no need to worry about the resiliency of non-inflatable, stretchable films which can affect the tightness in which the object is held.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. A protective package comprising:

first and second package frame members, each having inner surfaces including a planar face and side walls which define a well extending therebelow, the frame members having a hinge connection to permit movement between an opened position and a closed position wherein the frame members are positioned face-to-face;

structure for locking the frame members in the closed position;

a first collapsible film having outer edges secured to inner surfaces of the first frame member to create a first inflatable chamber between the first well and the first film;

a second collapsible film having outer edges secured to inner surfaces of the second frame member to create a second inflatable chamber between the second well and the second film;

a flexible tube extending across the hinge connection placing the first and second chambers in communication with each other; and one of the frame members having a one-way valve for introducing and maintaining a filler medium in the first and second chambers by means of a blowhole formed in one side wall of the one frame member.

2. The package of claim 1, wherein one of the frame members is provided with a relief valve for relieving air from the chambers.

3. The package of claim 2, wherein the relief valve is comprised of an aperture formed in one of the wells, and a closure strip attached to an external surface of the well to selectively open and close the aperture.

4. The package of claim 1, wherein each of the frame members is constructed of a rigid, clear plastic material.

5. The package of claim 1, wherein the first and second collapsible films are constructed of a clear plastic material.

6. The package of claim 1, wherein inner ends of the first and second collapsible films are formed with throughholes in communication with opposite ends of the flexible tube.

7. The package of claim 1, wherein the one-way valve is a duckbill valve.

8. The package of claim 1, wherein the filler medium is air.

9. In a package for protecting an object to be shipped, the package having a pair of rigid frame members, each having inner surfaces including a planar face and side walls which define a well extending therebelow, the frame members having a hinge connection to permit movement between an opened position and a closed position wherein the frame members are positioned face-to-face, the improvement comprising:

a collapsible film arrangement secured to inner surfaces of the frame members to define an inflatable chamber between the film arrangement and each well, each chamber being in communication with the other; and one of the frame members having a one-way valve for introducing air into the chamber by means of a blow hole formed in one side wall of the one frame member, wherein introduction of air into the chambers will maintain the shape of the frame members and cause the film arrangement to tightly collapse upon and adhere to substantially an entire surface area of an object placed on an inner surface of the film arrangement to protectively suspend the object between the frame members.

* * * * *